US009209579B2

(12) United States Patent
Mochizuki

(10) Patent No.: US 9,209,579 B2
(45) Date of Patent: Dec. 8, 2015

(54) CONNECTING STRUCTURE FOR ELECTRONIC DEVICE

(71) Applicant: YAZAKI CORPORATION, Tokyo (JP)

(72) Inventor: Shinji Mochizuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/895,120

(22) Filed: May 15, 2013

(65) Prior Publication Data

US 2013/0252476 A1 Sep. 26, 2013

Related U.S. Application Data

(63) Continuation of application No. PCT/JP2011/077279, filed on Nov. 18, 2011.

(30) Foreign Application Priority Data

Nov. 18, 2010 (JP) ..... 2010-258231

(51) Int. Cl.

| | |
|---|---|
| ***H01R 13/66*** | (2006.01) |
| ***H01R 24/00*** | (2011.01) |
| ***H01R 13/506*** | (2006.01) |

(Continued)

(52) U.S. Cl.

CPC ..... *H01R 24/00* (2013.01); *H01R 13/506* (2013.01); *H01R 13/641* (2013.01); *H01R 13/665* (2013.01); *H01R 13/7175* (2013.01); *H01R 13/6641* (2013.01)

(58) Field of Classification Search

USPC ..... 439/488, 489, 620.21, 752

See application file for complete search history.

(56) References Cited

U.S. PATENT DOCUMENTS 4,679,885 A 7/1987 Nestor et al.
6,109,973 A * 8/2000 Gronowicz et al. ..... 439/620.21

(Continued)

FOREIGN PATENT DOCUMENTS

JP 63-56578 U 4/1988
JP 63-150483 U 10/1988

(Continued)

OTHER PUBLICATIONS

International Search Report and Written Opinion of the International Search Report for PCT/JP2011/077279 dated Feb. 23, 2012.
Office Action from Korean Patent App. No. 10-2013-7012547 (May 27, 2014) with English translation thereof.
Office Action from Japanese Patent App. No. 2010-258231 (Nov. 13, 2014) with English translation thereof.

(Continued)

*Primary Examiner* — Tho D Ta
(74) *Attorney, Agent, or Firm* — Kenealy Vaidya LLP

(57) ABSTRACT

A connecting structure includes a housing which is inserted into a cover, and a terminal which is accommodated in the housing and holds an electronic device. The housing allows the electronic device to be inserted from an outside of the housing into the housing in a state where the terminal is accommodated in the housing. The cover comes in contact with the electronic device in a state where a part of the electronic device is inserted to the terminal. The cover allows the housing to be inserted into the cover in a state where whole part of the electronic device is inserted into the housing to be held at a normal position by the terminal. The cover has an abutting face preventing the electronic device from slipping out from the housing in a state where the housing is inserted into the cover.

6 Claims, 12 Drawing Sheets

(51) Int. Cl.
*H01R 13/641* (2006.01)
*H01R 13/717* (2006.01)

(56) References Cited

U.S. PATENT DOCUMENTS

| | | | |
|---|---|---|---|
| 2003/0133302 | A1 | 7/2003 | Kamiya et al. |
| 2007/0127216 | A1 | 6/2007 | Kamiya et al. |
| 2008/0014783 | A1 | 1/2008 | Shimirak |
| 2009/0305561 | A1 | 12/2009 | Yao et al. |

FOREIGN PATENT DOCUMENTS

| | | | |
|---|---|---|---|
| JP | 2003-258314 | A | 9/2003 |
| JP | 2007-149762 | A | 6/2007 |
| JP | 2009-021616 | A | 1/2009 |

OTHER PUBLICATIONS

Office Action from Chinese Patent App. No. 201180055735.9 (Jan. 30, 2015) with English translation thereof.

Office Action from Korean Patent App. No. 10-2013-7012547(Apr. 16, 2015) with English translation thereof.

Japanese Office Action for the related Japanese Patent Application No. 2010-258231 dated Sep. 3, 2014.

Korean Office Action for the related Korean Patent Application No. 10-2013-7012547 dated Nov. 28, 2014.

Japanese Office Action, Notification of Reasons for Refusal for the related Japanese Patent Application No. 2010-258231 dated Aug. 11, 2015.

Office Action from Chinese Patent App. No. 201180055735.9 (Sep. 14, 2015) with English language translation thereof.

* cited by examiner

CONNECTING STRUCTURE FOR ELECTRONIC DEVICE

BACKGROUND

The present invention is related to a connecting structure for electronic device which is connected by an insertion into a housing.

Patent Document1 discloses a connecting structure for electronic device that assuredly electrically connects the electronic device to obtain a high reliability. As shown in FIG. 17, in the connecting structure of the electronic device, one pair of busbars 501 and 503 are attached to a housing and a semiconductor light emitting element (LED) 505 as a light source is also attached to the housing. The busbars 501 and 503 that are formed in the shapes of flat plates and are divided into two include an electric wire connecting part 507, a Zener diode connecting part 509, a resistor connecting part 511 and an LED connecting part 513. In the resistor connecting part 511, press contact blades 515 and 515 are provided respectively in the busbars 501 and 503 that are divided into two. In the Zener diode connecting part 509, a single press contact blade 517 is provided in the one busbar 501 and a single press contact blade 519 is provided in the other busbar 503.

In a Zener diode 521, one lead part 523 is electrically connected to the one busbar 501 and the other lead part 525 is electrically connected to the other busbar 503 respectively, so that the Zener diode 521 is connected in parallel with the one pair of busbars 501 and 503 in the downstream side of a resistor 527. Thus, the Zener diode functions to protect the LED from a damage due to a sudden large voltage applied to a circuit by a static electricity in a direction where a forward electromotive force is supplied to the diode and to prevent a current from being supplied in a direction where a counter electromotive force is supplied to the diode and similarly protect the LED from the damage.

[Patent Document1] JP-A-2007-149762

SUMMARY

However, in the conventional connecting structure of the electronic device, since the Zener diode 521 is pushed in to the press contact blades 517 and 519 and the resistor 527 is pushed in to the press contact blades 515 and 515 to be electrically connected, a partial inserted state of these electronic device is hardly detected. Further, since the above-described electronic device are held only by pushing in the lead parts to the press contact blades 517 and 519, and the press contact blades 515 and 515, a reliability of an electric contact is hardly sufficiently ensured.

It is therefore one advantageous aspect of the present invention to provide a connecting structure that can detect a partial inserted state of electronic device and prevent the electronic device from slipping out.

According to one advantage of the invention, there is provided a connecting structure for an electronic device, the connecting structure comprising:

a cover;

a housing, configured to be inserted into the cover; and a terminal, accommodated in the housing, and configured to hold an electronic device, wherein the housing allows the electronic device to be inserted from an outside of the housing into the housing in a state where the terminal is accommodated in the housing, wherein the cover is configured to come in contact with the electronic device in a state where a part of the electronic device is inserted to the terminal, wherein the cover is configured to allow the housing to be inserted into the cover in a state where whole part of the electronic device is inserted into the housing to be held at a normal position by the terminal, and wherein the cover has an abutting face preventing the electronic device from slipping out from the housing in a state where the housing is inserted into the cover.

The connecting structure may be configured such that a direction in which the electronic device is inserted to the housing is orthogonal to a direction in which the housing is inserted to the cover.

The connecting structure may be configured such that the cover is formed with an opening through which the housing is inserted to the cover, and an inner edge part of the opening has at least one of a tapered face and a rounded face.

DETAILED DESCRIPTION OF EXEMPLIFIED EMBODIMENTS

Figure 1:
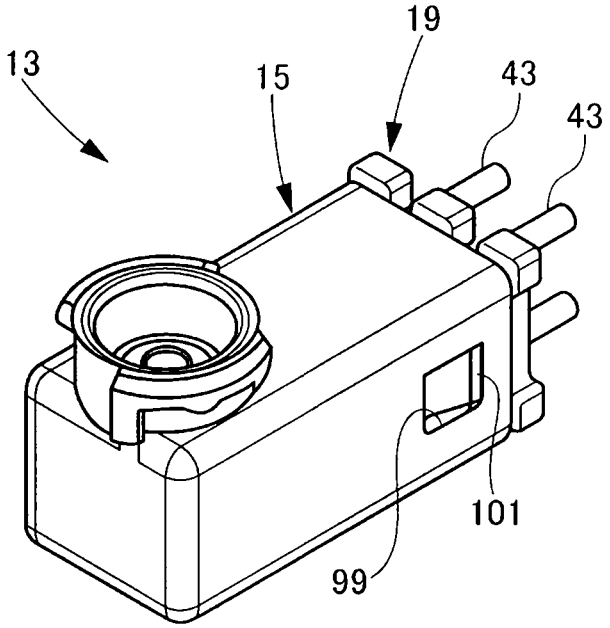
FIG. 1 is a perspective view of an LED unit having a connecting structure for electronic device according to the present invention.

An embodiment of the present invention will be described below by referring to the drawings.

Figure 2:
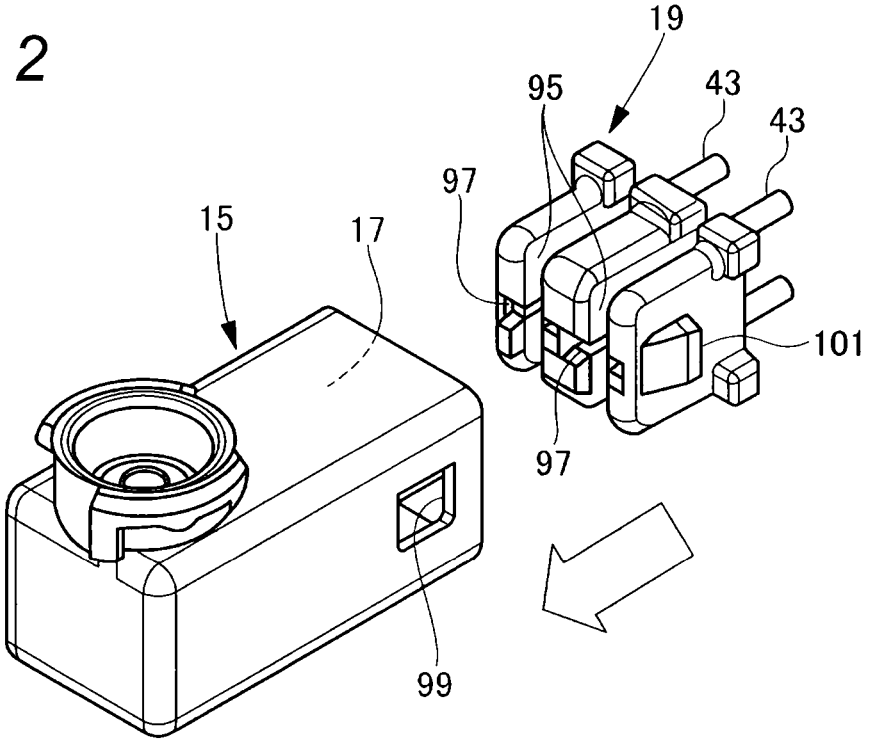
FIG. 2 is an exploded perspective view of the LED unit shown in FIG. 1 and an electric wire holder.
Figure 3:
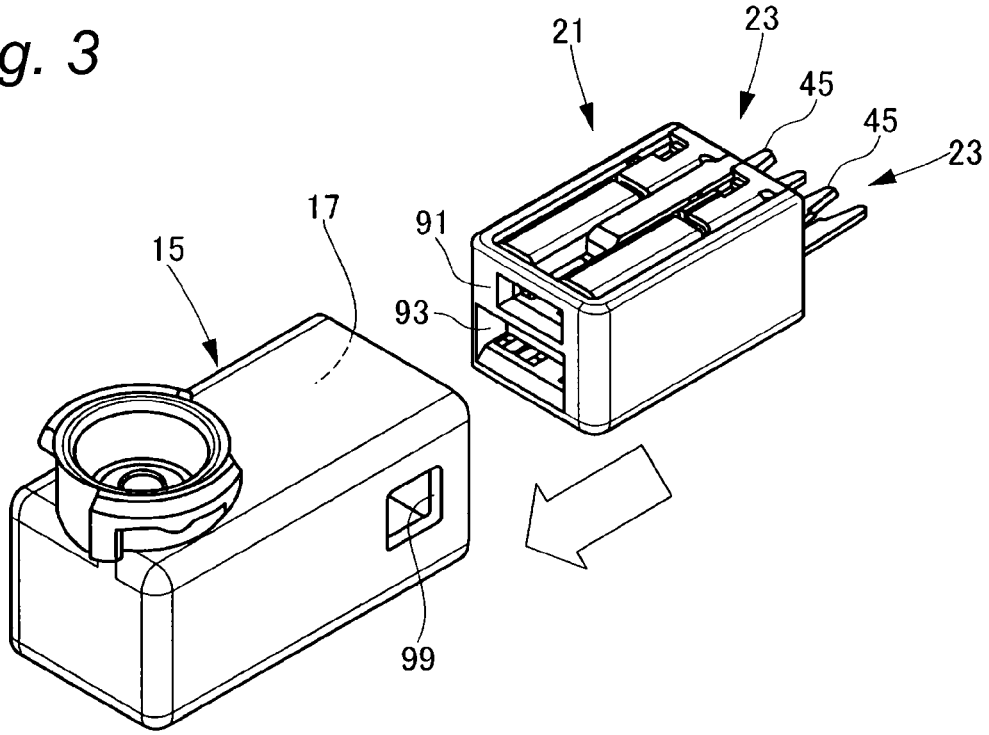
FIG. 3 is an exploded perspective view of the LED unit and a housing.

FIG. 1 is a perspective view of an LED unit having a connecting structure for electronic device according to the present invention. FIG. 2 is an exploded perspective view of the LED unit shown in FIG. 1 and an electric wire holder. FIG. 3 is an exploded perspective view of the LED unit and a housing.

A connecting structure for electronic device according to the present embodiment is preferably used in, for example, an LED unit 13 shown in FIG. 1. The LED unit 13 has an electric wire holder 19 shown in FIG. 2 attached to a housing inserting opening 17 provided in a rear part side of a lens cover 15. In the present embodiment, the housing inserting opening 17 side of the lens cover 15 is referred to as a "rear" and an opposite side thereto is referred to as a "front". Before the electric wire holder 19 is attached to the lens cover 15, a housing 21 shown in FIG. 3 is previously attached to the lens cover 15. To the housing 21, two terminals 23 having the same form shown in FIG. 3 are attached.

Figure 4:
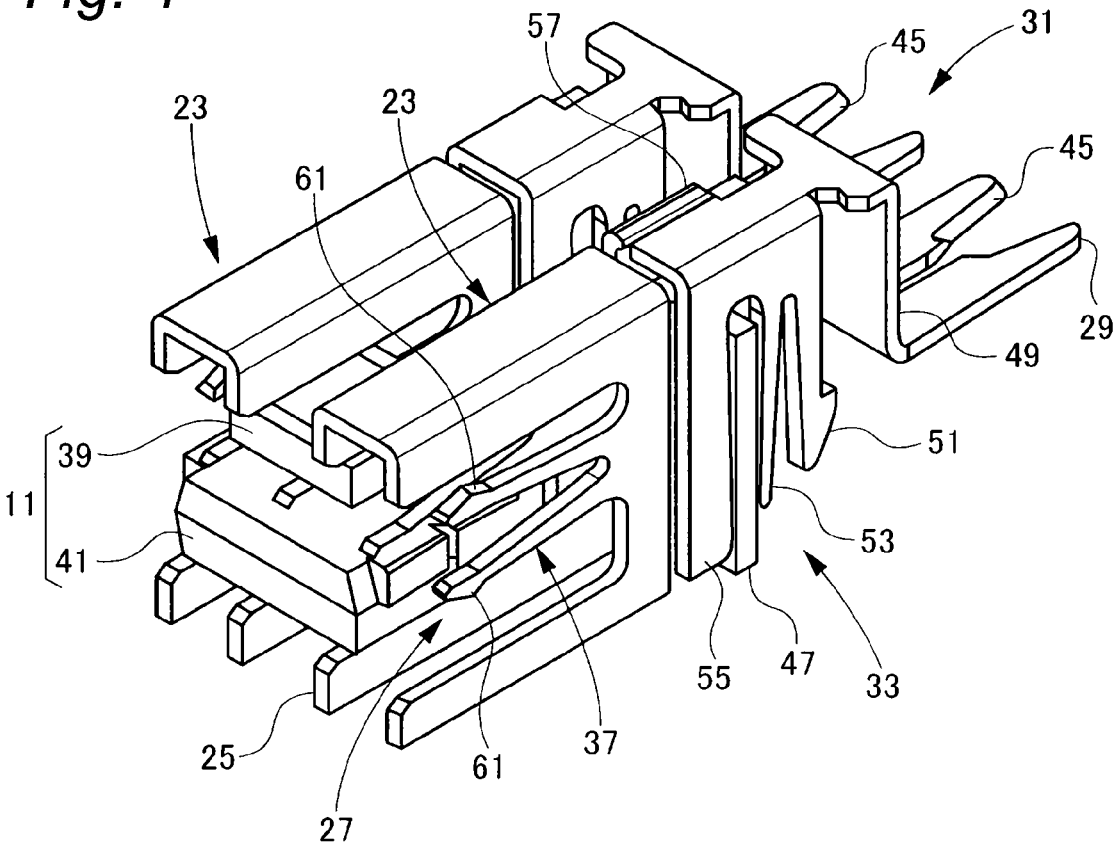
FIG. 4 is an enlarged perspective view of a terminal shown in FIG. 3.

FIG. 4 is an enlarged perspective view of the terminals 23 shown in FIG. 3.

The two terminals 23 form a first press contact part 27 in one end 25, a second press contact part 31 in the other end 29 and a third press contact part 33 in an intermediate part between the first press contact part 27 and the second press contact part 31, which are spaced from each other and arranged in parallel. In the first press contact part 27, at least one pair of main contact spring pieces 37 which can respectively come into resilient contact with pairs of contact parts of two electronic device 11 are arranged and opposed to each other. In the present embodiment, in one terminal 23, one pair of main contact spring pieces 37 are provided. Between the two terminals, the one pair of adjacent main contact spring pieces 37 are connected to one pair of contact parts of a semiconductor light emitting element 39 as the first electronic device 11. Further, the other pair of main contact spring pieces 37 located between the two terminals are connected to one pair of contact parts of a Zener diode 41 as the second electronic device 11.

Figure 5:
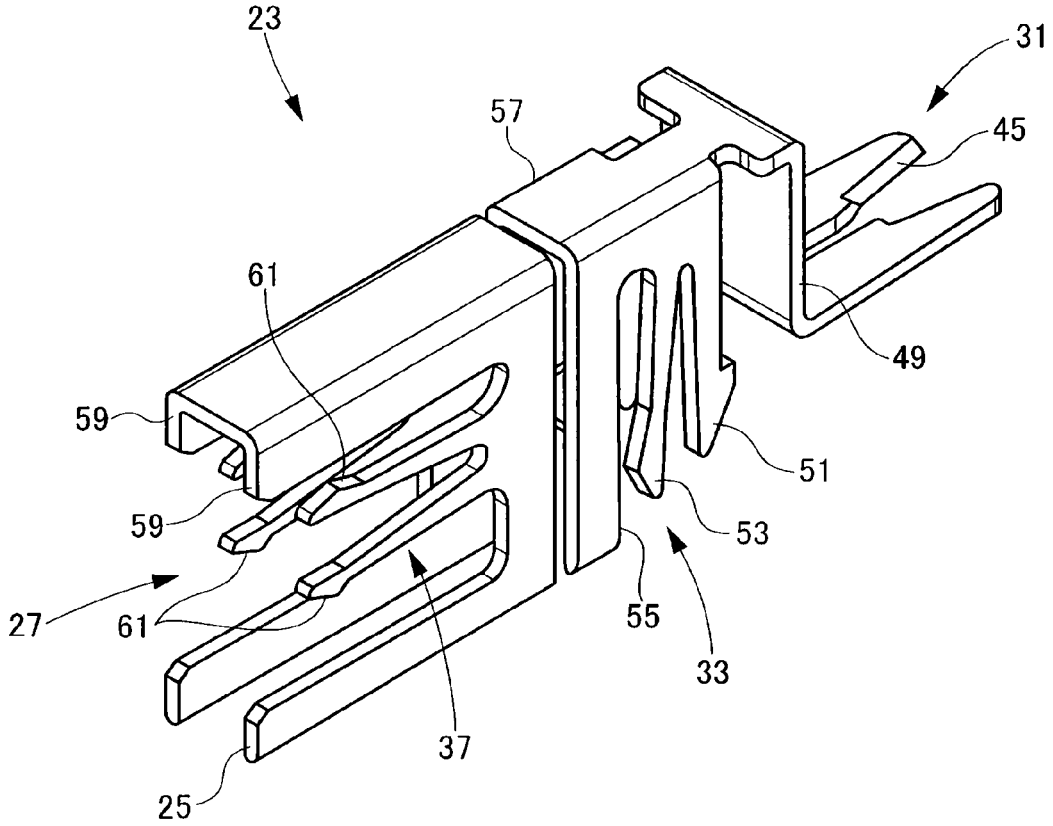
FIG. 5 is a perspective view of a single body of the terminal shown in FIG. 4

FIG. 5 is a perspective view of the one terminal 23 shown in FIG. 4.

A part of the terminal 23 protrudes to an external part of the housing 21 under a state that the terminal is attached to the housing 21. A rear end of the terminal 23 forms the above-described second press contact part 31. In the second press contact part 31, press contact blades 45 are provided that cut and tear a coating of a coated electric wire 43 (see FIG. 2) to come into electric contact with a conductor.

In a front part of the press contact blades 45, the third press contact part 33 is provided. Namely, in the intermediate part between the first press contact part 27 and the second press contact part 31, the third press contact part 33 is provided. The third press contact part 33 can come into press contact with other electronic device 11, for instance, a resistor 47 shown in FIG. 4. In the third press contact part 33, a rear part abutting piece 49, a rear part resilient leg 51, an auxiliary contact spring piece 53 and a front part abutting piece 55 are connected forward from the press contact blades 45.

To the front part abutting piece 55 of a back surface side in FIG. 5, the first press contact part 27 as one end 25 (a front end) of the terminal 23 is connected through a connecting part 57. The press contact blade 45, the rear part abutting piece 49, the rear part resilient leg 51, the auxiliary contact spring piece 53, the front part abutting piece 55 and the first press contact part 27 are integrally stamped by a thin plate working, and then, bent to a form shown in FIG. 5. The first press contact part 27 of the terminal 23 is bent in the shape of U so that a pair of side walls 59 are parallel to each other, and the main contact spring pieces 37 are stamped and formed respectively in the side walls 59. A main body of the terminal 23 is bent and formed in the shape of U and the main contact spring pieces 37 are formed in the one pair of opposed side walls 59 by a stamping work. Thus, a resiliently connecting structure having many electric contact parts 61 can be easily and compactly manufactured.

Figure 6C:
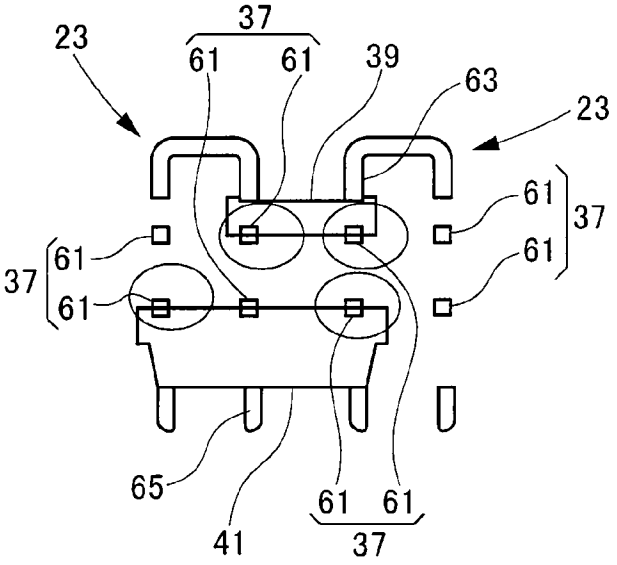
FIG. 6C is a diagram seen from a line B-B in FIG. 6A.
Figure 6B:
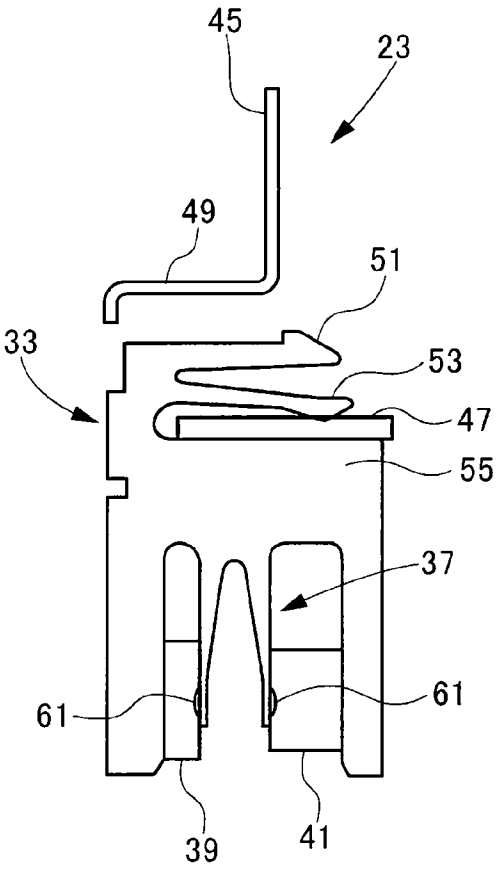
FIG. 6B is a diagram seen from a line A-A in FIG. 6A.
Figure 6A:
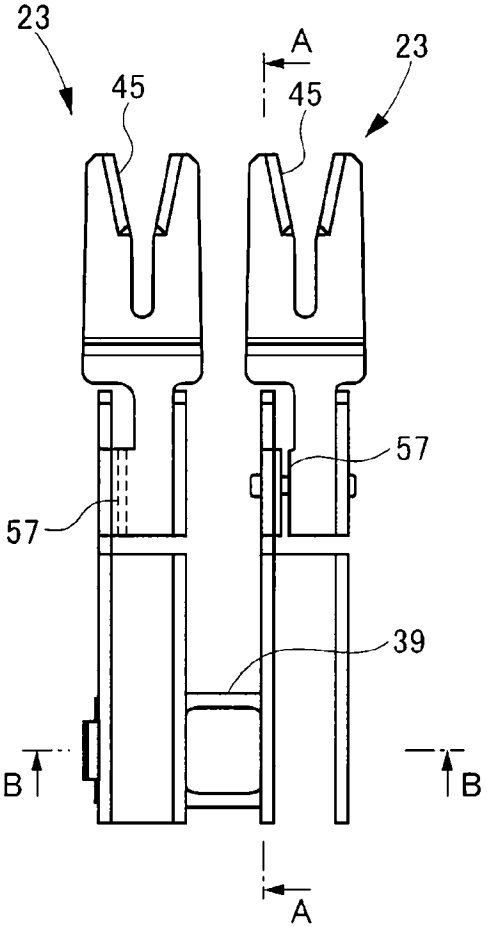
FIG. 6A is a plan view of the terminal shown in FIG. 4.
Figure 7A:
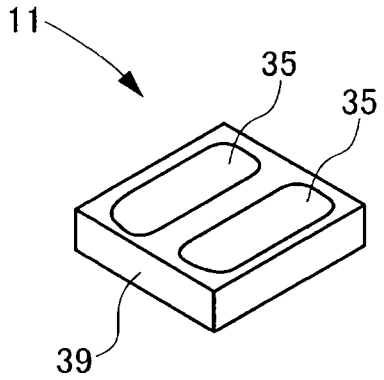
FIG. 7A is a perspective view of a semiconductor light emitting element.
Figure 7B:
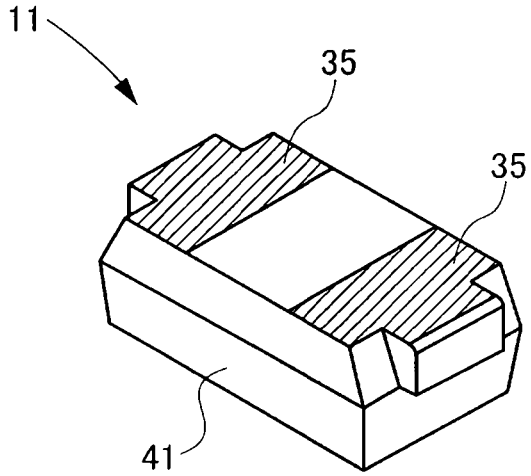
FIG. 7B is a perspective view of a Zener diode.
Figure 7C:
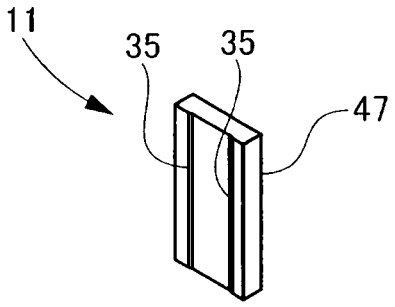
FIG. 7C is a perspective view of a resistor.

FIG. 6A is a plan view of the terminal 23 shown in FIG. 4, FIG. 6B is a view seen from a line A-A thereof, and FIG. 6C is a view seen from a line B-B thereof. FIG. 7A is a perspective view of the semiconductor light emitting element 39, FIG. 7B is a perspective view of the Zener diode 41 and FIG. 7C is a perspective view of the resistor 47.

In the one terminal 23, one pair of main contact spring pieces 37 are formed in parallel and ends which branch substantially in the shape of Y form the electric contact parts 61. The electric contact parts 61 are formed in triangular shapes having contacts as apex angles. As shown in FIG. 6A, the two terminals 23 are spaced from each other and arranged in parallel. Thus, as shown in FIG. 6C, the electric contact parts 61 are arranged at eight positions including four positions in each of sides. To the electric contact parts 61 at the four positions of the one side of a rear part, rear parts seat parts 63 respectively formed in the terminals 23 are opposed. Further, to the electric contact parts 61 at the four positions of the one side of a front part, front parts seat parts 65 respectively formed in the terminals 23 are opposed.

Between the rear parts seat parts 63 and the electric contact parts 61 at the four positions of the one side of the rear part, the semiconductor light emitting element 39 is mounted. Between the electric contact parts 61 at the four positions of the one side of the front part and the front parts seat parts 65, the Zener diode 41 is mounted. As shown in FIG. 7A, the semiconductor light emitting element 39 is the electronic device 11 to be mounted on a surface which has the one pair of contact parts 35 provided on one surface. Further, as shown in FIG. 7B, the Zener diode 41 is also the electronic device 11 to be mounted on a surface which has the one pair of contact parts 35 provided on one surface. Further, as shown in FIG. 7C, the resistor 47 is also the electronic device 11 to be mounted on a surface which has the one pair of contact parts 35 provided on one surface.

In the semiconductor light emitting element 39, as shown in FIG. 6C, the surface on which the contact parts 35 are provided is directed to the electric contact parts 61 on an upper stage and a back surface is allowed to abut on the rear parts seat parts 63. In the Zener diode 41, the surface on which the contact parts 35 are provided is directed to the electric contact parts 61 side of a lower stage and a back surface is allowed to abut on the front parts seat parts 65. In the present embodiment, a pitch between contacts of the semiconductor light emitting element 39 is smaller than a pitch between contacts of the Zener diode 41. Namely, the two electronic devices 11 have different pitches between contacts. In the connecting structure of the electronic device 11, the electronic device 11 having the different pitches between the contacts as described above can be mounted at the same time. Namely, as shown in FIG. 6C, in one side, the one pair of contact parts 35 of the semiconductor light emitting element 39 come into contact with the adjacent electric contact parts 61 of the two terminals 23. In the other side, the electric contact parts 61 of the two terminals 23 come into contact with the one pair of contact parts 35 of the Zener diode 41 by striding over at least one electric contact part 61.

In FIG. 6C, the semiconductor light emitting element 39 is connected to the second electric contact part 61 from a left side and the third electric contact part 61 from the left side in the electric contact parts 61 of the upper stage. Further, the Zener diode 41 is connected to the first electric contact part 61 from a left side and the third electric contact part 61 from the left side in the electric contact parts 61 of the lower stage, however, the Zener diode 41 may be connected to the second electric contact part 61 from the left side and the fourth electric contact part 61 from the left side. Further, in the present embodiment, the Zener diode 41 is used in which the pitch between the contacts has a distance two times as large as a pitch between contacts of the electric contact part 61, however, the Zener diode may be used in which the pitch between the contacts has a distance three times as large as the pitch between the contacts of the electric contact part 61. In this case, the one pair of contact parts 35 of the Zener diode 41 are connected to the first electric contact part 61 from the left side and the fourth electric contact part 61 from the left side.

Figure 8:
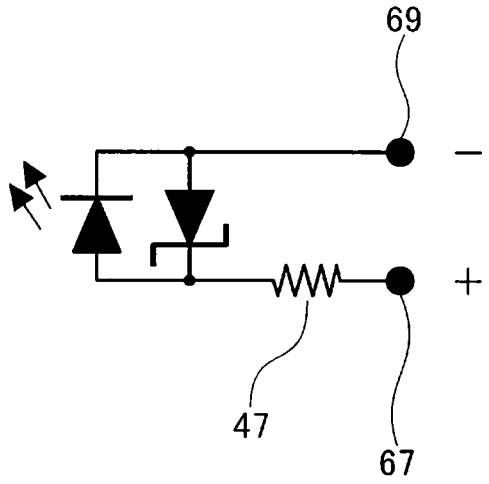
FIG. 8 is a circuit diagram in the connecting structure of the electronic device.

FIG. 8 is a circuit diagram in the connecting structure of the electronic device 11.

In the connecting structure of the electronic device 11, the semiconductor light emitting element 39 and the Zener diode 41 are connected in parallel between an anode 67 and a cathode 69. In such a connecting structure of the electronic device 11, a circuit is supposed to have the resistor 47 provided between the semiconductor element 39 and the Zener diode 41 and the anode 67. In such a case, in the third press contact part 33 of this structure, as shown in FIG. 6A, during a connection of the resistor 47, the connecting part 57 is separated between one pair of auxiliary contact spring pieces 53 which are respectively connected to one pair of contact parts 35 of the resistor 47.

Figure 9B:
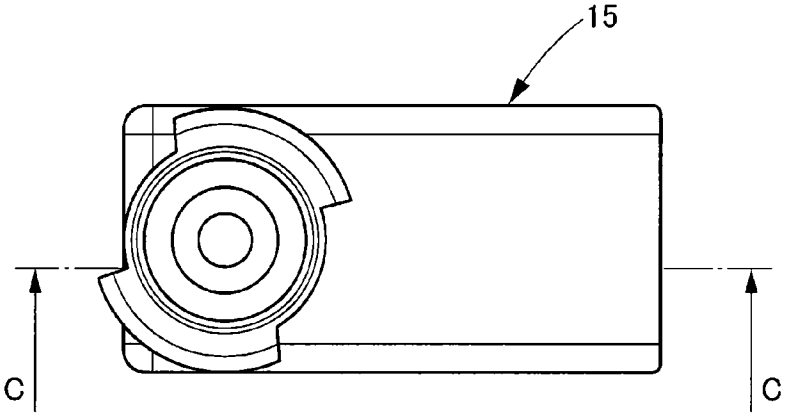
FIG. 9B is a plan view of the lens cover shown in FIG. 9A.
Figure 9C:
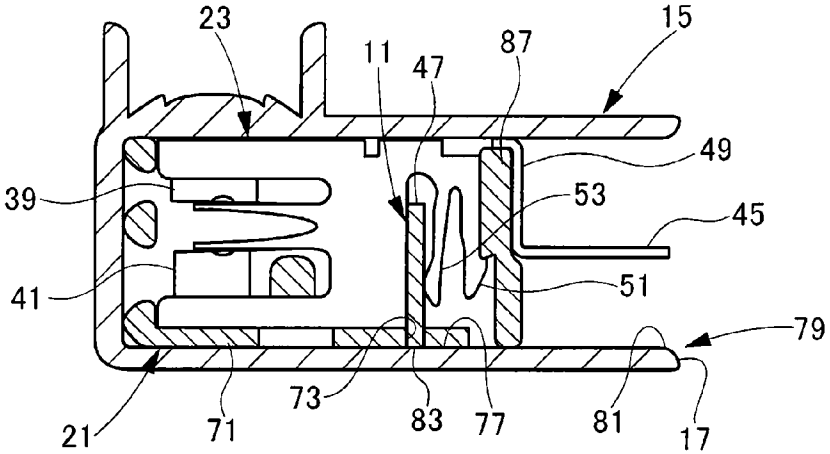
FIG. 9C is a diagram seen from a line C-C in FIG. 9B.
Figure 9A:
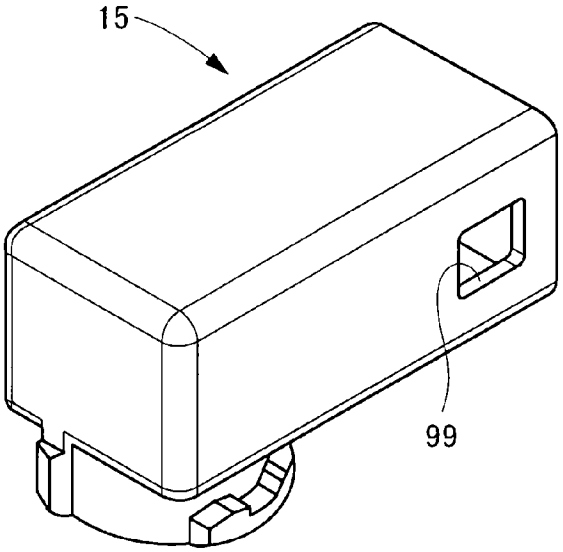
FIG. 9A is a perspective view of a lens cover to which the housing is fitted.

FIG. 9A is a perspective view of the lens cover 15 to which the housing 21 is fitted, FIG. 9B is a plan view thereof and FIG. 9C is a diagram seen from a line C-C in FIG. 9B.

Into the housing 21, the resistor 47 can be inserted from an outside of the housing 21 under a state that the terminals 23 are accommodated therein. On a bottom plate 71 of the housing 21, a bottom plate opening part 73 is formed for attaching the resistor 47. On the bottom plate opening part 73, a pair of holding grooves are provided. Namely, the terminals 23 are inserted into the housing 21 from an upper side (an upper side of FIG. 9C) of the housing 21 and the resistor 47 is inserted into the housing 21 from a lower side of the housing 21.

An inserting direction of the resistor 47 into the housing 21 intersects at right angles to a fitting direction of the housing 21 to the lens cover 15. Thus, in the lens cover 15, the resistor 47 abuts on the housing inserting opening 17 under a state that a part of the resistor 47, for example a half of the resistor 47, is inserted into the terminals 23. On the other hand, under a state that whole part of the resistor 47 is inserted into the housing to be held in a normal position by the terminal 23, the lens cover 15 permits the housing 21 to be fitted. Further, the lens cover 15 has an abutting surface 77 opposed to the bottom plate opening part 73 that prevents the resistor 47 from slipping out.

Further, in an inner side edge part 79 of the housing inserting opening 17 of the lens cover 15, a tapered or rounded guide surface 81 is provided that is formed by removing an edge. The guide surface 81 serves to abut on an inserting rear part 83 of the resistor 47 slightly protruding from the bottom plate opening part 73.

Now, an attaching process of the connecting structure of the electronic device 11 having the above-described structure will be described below.

Figure 10:
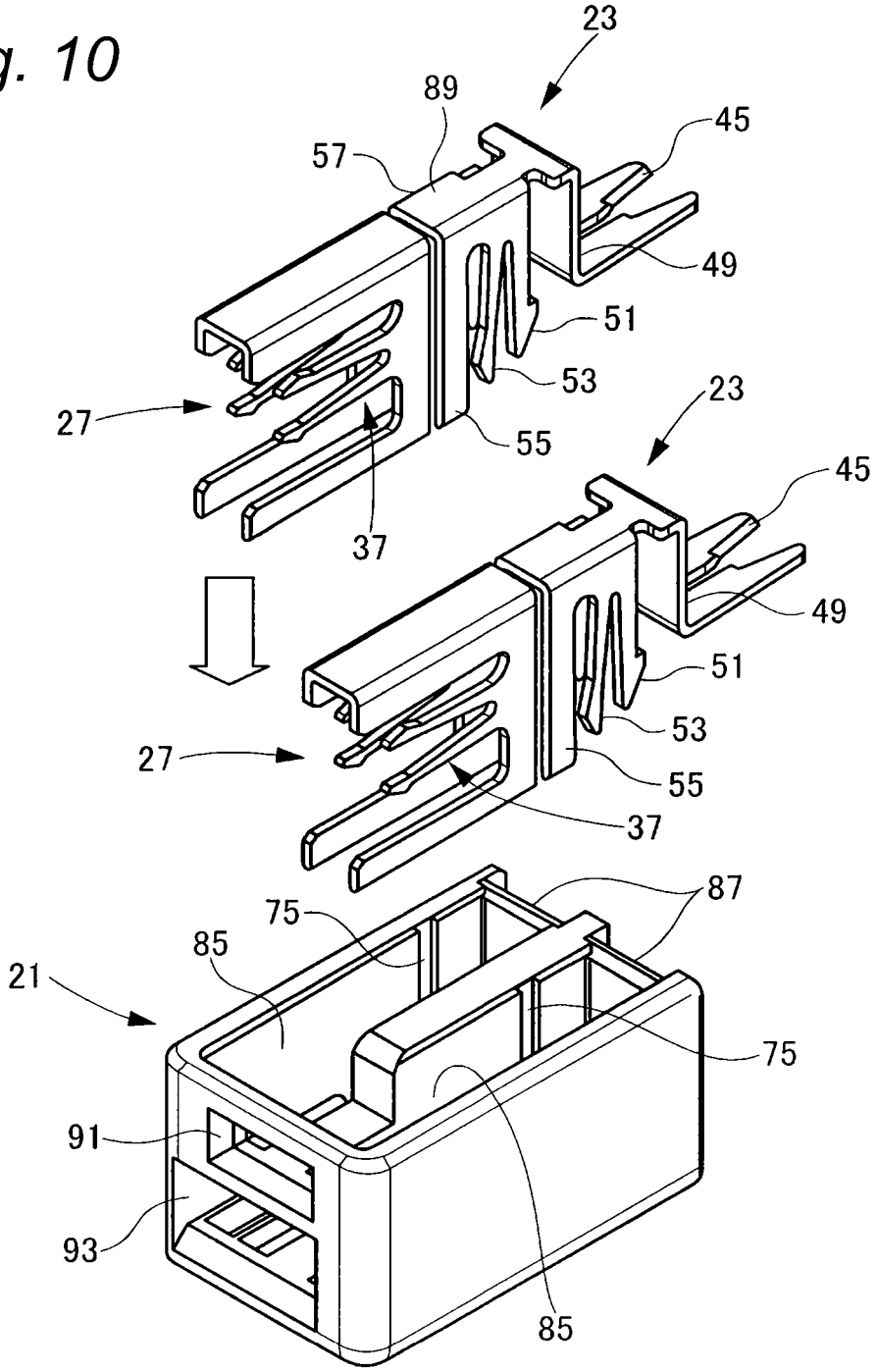
FIG. 10 is an attaching process diagram of the terminal.
Figure 11:
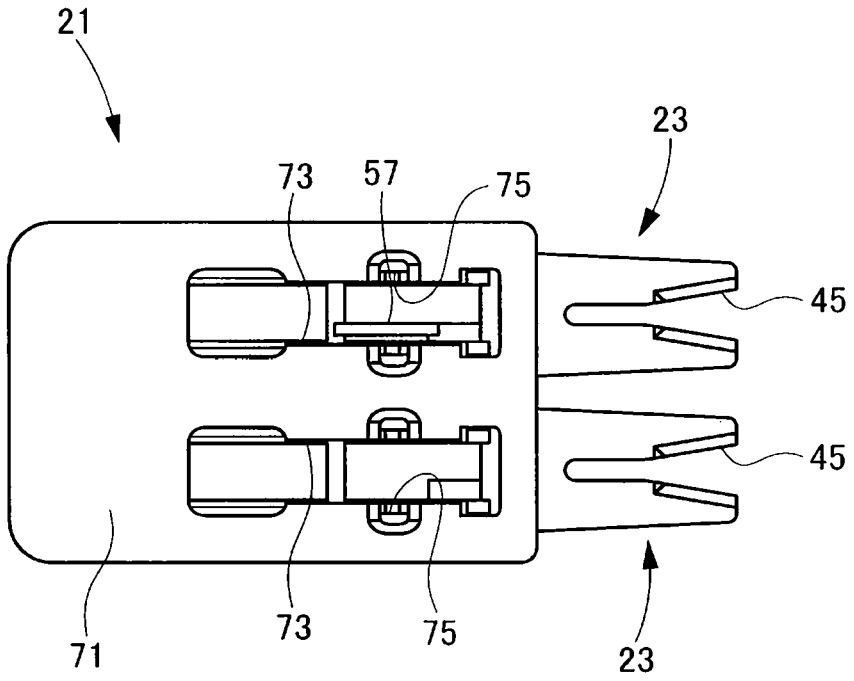
FIG. 11 is a cutting process diagram of a connecting part.
Figure 12:
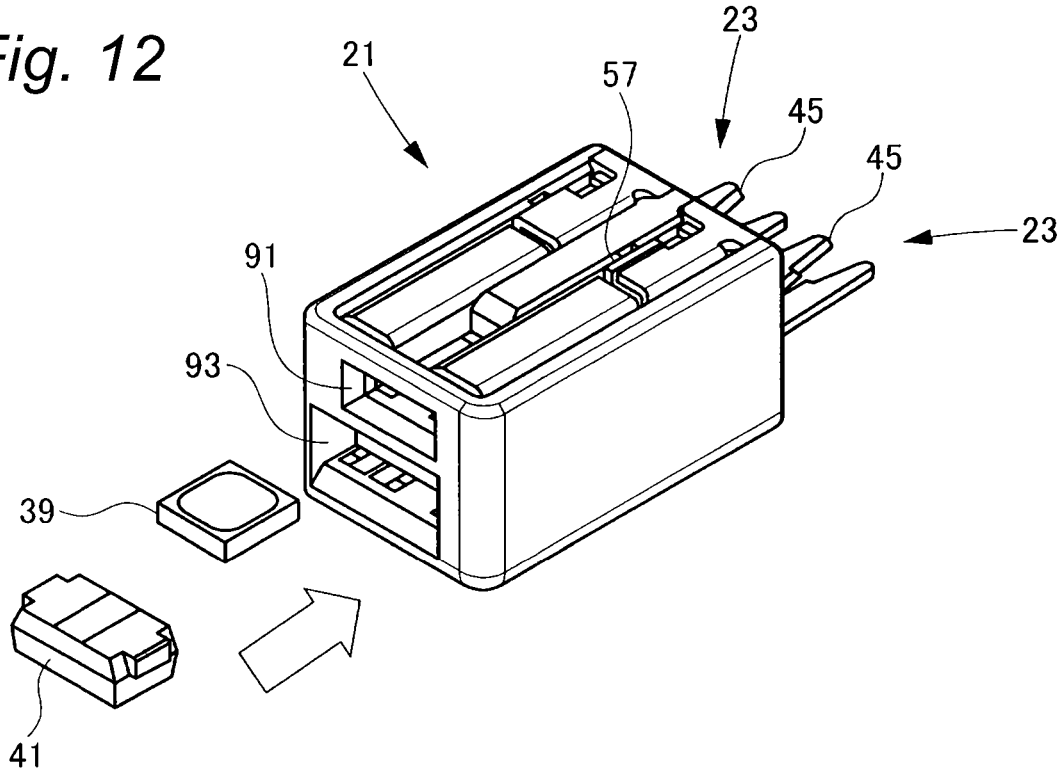
FIG. 12 is an attaching process diagram of the electronic device.
Figure 13:
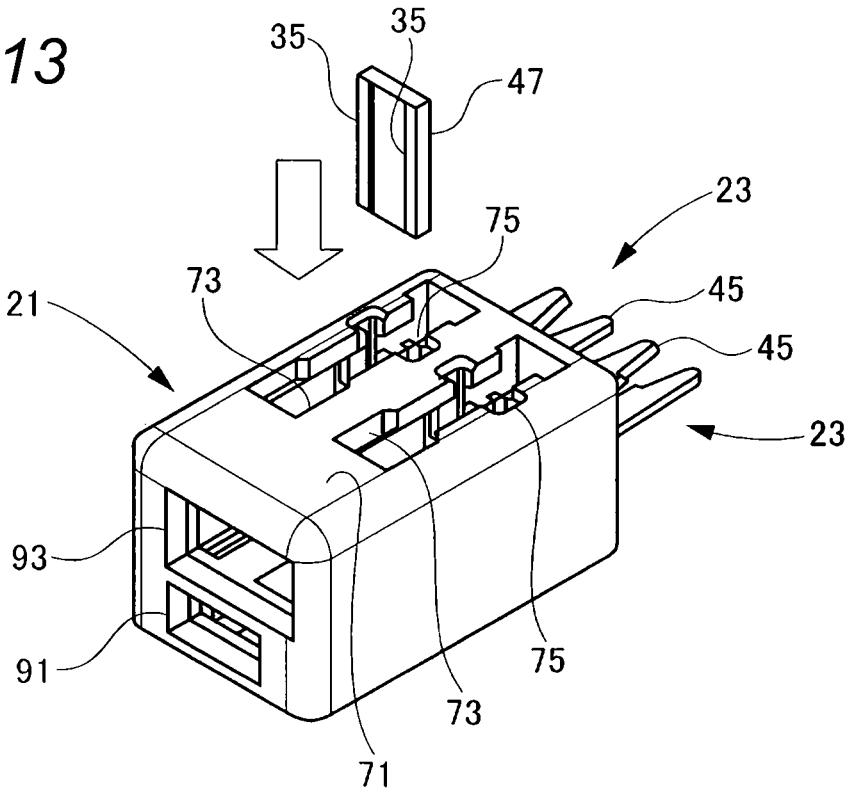
FIG. 13 is an attaching process diagram of the resistor.
Figure 14:
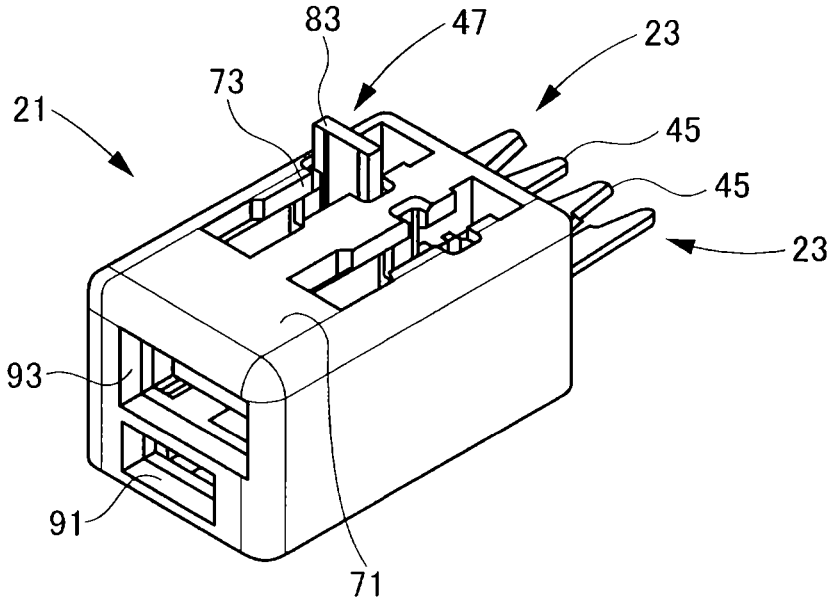
FIG. 14 is a perspective view of the housing showing a state that the resistor is half inserted.
Figure 15B:
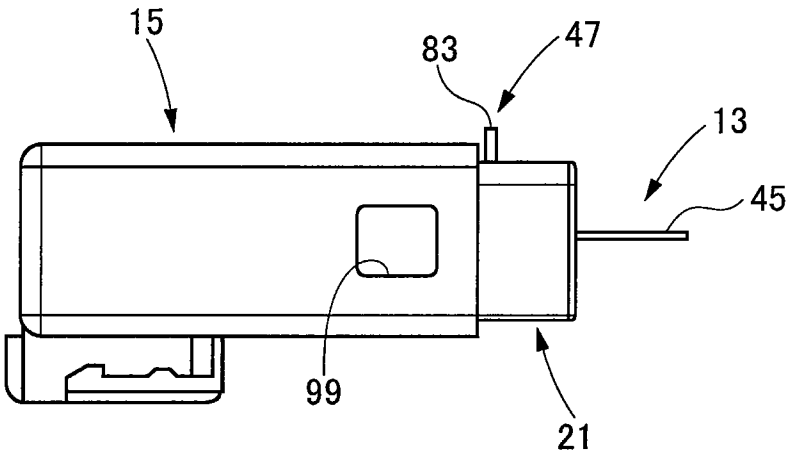
FIG. 15B is a side view of the lens cover shown in FIG. 15A.
Figure 15A:
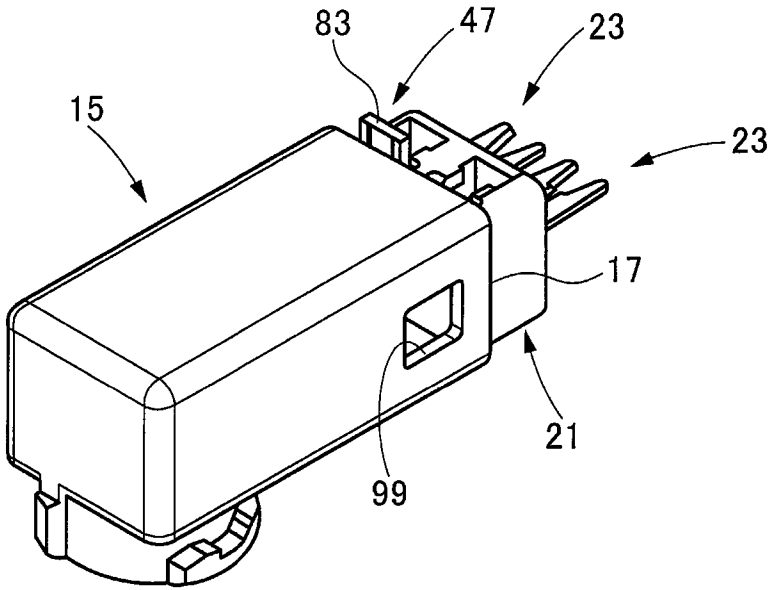
FIG. 15A is a perspective view of the lens cover showing that an inserting rear part of the resistor abuts on a housing inserting opening.
Figure 16:
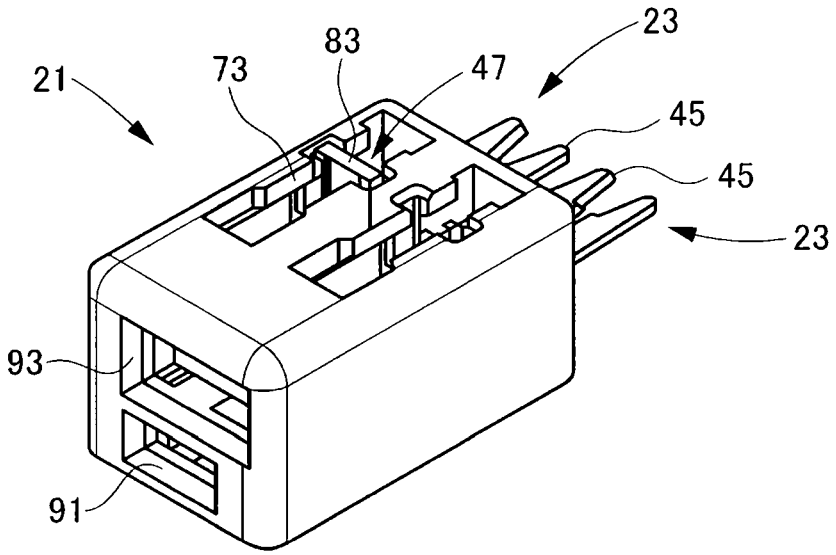
FIG. 16 is a perspective view of the housing showing a state that the resistor is normally held.
Figure 17:
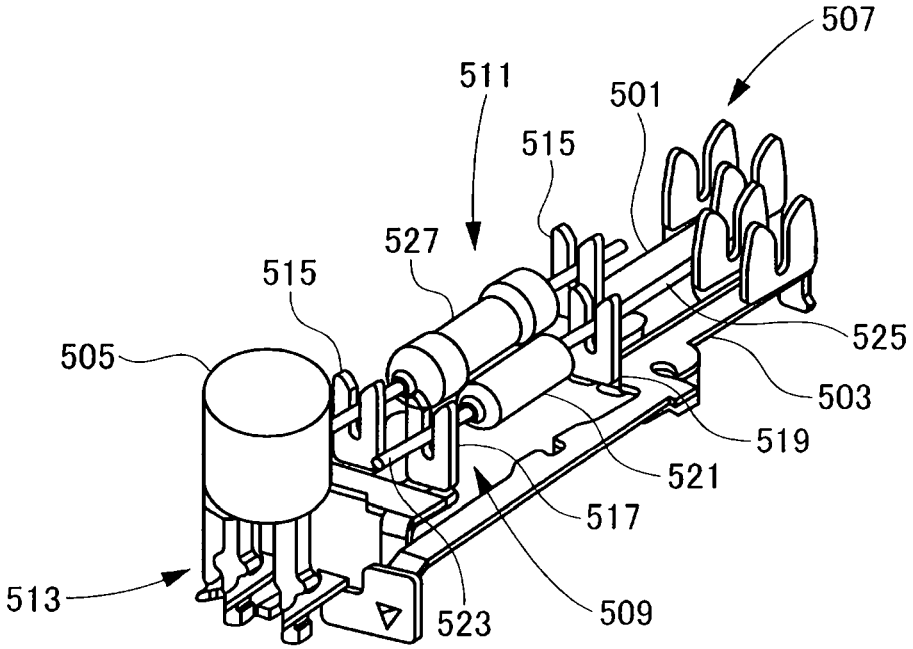
FIG. 17 is a perspective view of a conventional connecting structure for electronic device.

FIG. 10 is an attaching process diagram of the terminal. FIG. 11 is a cutting process diagram of the connecting part 57. FIG. 12 is an attaching process diagram of the electronic device. FIG. 13 is an attaching process diagram of the resistor 47. FIG. 14 is a perspective view of the housing 21 showing a state that the resistor 47 is half inserted. FIG. 15A is a perspective view of the lens cover 15 showing that the inserting rear part 83 of the resistor 47 abuts on the housing inserting opening 17 and FIG. 15B is a side view thereof. FIG. 16 is a perspective view of the housing 21 showing a state that the resistor 47 is normally held.

In order to assemble the LED unit 13, as shown in FIG. 10, the two terminals 23 are attached to the housing 21. In the housing 21, two terminal accommodating chambers 85 are formed. The terminal accommodating chambers 85 have rear ends as rear walls 87. On inner wall surfaces of front parts of the rear walls 87, one pair of holding grooves 75 are respectively formed in the terminal accommodating chambers 85. The terminal 23 inserted into the terminal accommodating chamber 85 holds the rear wall 87 between the rear part abutting piece 49 and the rear part resilient leg 51 to restrain the terminal from slipping out from the housing 21 and complete the attachment of the terminal 23.

As shown in FIG. 11, when the terminals 23 are attached to the housing 21, the connecting part 57 of the one terminal 23 is cut. The terminal 23 inserted into the terminal accommodating chamber 85 has the connecting part 57 located in a front surface 89 (see FIG. 10) in an inserting direction. Thus, whether or not the connecting part 57 is cut in a cut area can be easily recognized by visually recognizing the front surface 89 in the inserting direction from an inserting side of the terminal accommodating chamber 85.

As shown in FIG. 12, on a front surface of the housing 21, an LED attaching opening part 91 and a diode attaching opening part 93 are formed in two upper and lower stages. Into the LED attaching opening part 91, the semiconductor light emitting element 39 is inserted with the contact parts 35 directed downward. Into the diode attaching opening part 93, the Zener diode 41 is inserted with the contact parts 35 directed upward. Thus, as shown in FIG. 6C, the contact parts 35 are respectively connected to their electric contact parts 61.

As shown in FIG. 13, after the semiconductor light emitting element 39 and the Zener diode 41, the resistor 47 is inserted. The resistor 47 is inserted with both edge parts guided by the holding grooves 75 from the bottom plate opening part 73, so that the contact parts 35 are respectively connected to the one pair of auxiliary contact spring pieces 53.

Here, as shown in FIG. 14, when the resistor 47 is half inserted into the housing, since the fitting direction of the housing 21 to the lens cover 15 intersects at right angles to the inserting direction of the resistor 47 into the housing 21 as shown in FIG. 15B, the housing inserting opening 17 of the lens cover 15 abuts on the resistor 47 which is half inserted and protrudes from the housing 21. At this time, the electronic device 11 is not moved forward or backward in the inserting direction, so that an insertion of the housing 21 can be assuredly prevented. In other words, a partial inserted state can be detected.

On the other hand, as shown in FIG. 16, when the resistor 47 is in a normally held state, the lens cover 15 permits the housing 21 to be fitted and complete the attachment of the housing 21 as shown in FIG. 9C. When the attachment of the housing 21 is completed, the abutting surface 77 is arranged on the bottom plate opening part 73 so that the inserting rear part 83 of the resistor 47 abuts on the abutting surface 77 to assuredly prevent the resistor 47 from slipping out.

Further, under a holding state that the inserting rear part 83 of the resistor 47 slightly protrudes, when the housing 21 is inserted into the lens cover 15, the inserting rear part 83 of the resistor 47 abuts on the guide surface 81 (see FIG. 9C) provided in the inner side edge part 79 of the housing inserting opening 17. Then, when the housing 21 is more inserted, the resistor 47 is pushed in to a normally held state by a reaction force from the guide surface 81. Thus, the resistor 47 can be assuredly attached under a normally held state to ensure an electric connection.

The housing 21 inserted into the lens cover 15 has the press contact blades 45 protruding rearward in the lens cover 15.

Into the lens cover 15 to which the housing 21 is attached, the electric wire holder 19 is inserted from the housing inserting opening 17 as shown in FIG. 2. In three outer surfaces of the electric wire holder 19, U shaped electric wire holding grooves 95 are formed at two positions. To the electric wire holding grooves 95, the coated electric wires 43 are respectively bent in the shapes of U and attached. On a front surface of the electric wire holder 19, horizontal press contact blade entering slits 97 are formed which respectively extend over the electric wire holding grooves 95. Thus, when the electric wire holder 19 is inserted into the lens cover 15, the press contact blades 45 protruding rearward in the lens cover 15 enter the press contact blade entering slits 97 to connect the press contact blades 45 to the conductors of the electric wires 43.

In the electric wire holder 19 inserted into the lens cover 15, an engaging pawl 101 protruding in a side surface is engaged with an engaging hole 99 formed in a side part of the lens cover 15 to regulate the disengagement of the housing 21 and the electric wire holder itself from the lens cover 15. When the housing 21 and the electric wire holder 19 are attached to the lens cover 15, the assembly of the LED unit 13 shown in FIG. 1 is finished.

As described above, in the connecting structure of the electronic device 11, under a state that the resistor 47 is half inserted into the housing, when the housing 21 is to be fitted to the lens cover 15, the inserting rear part 83 of the resistor 47 protruding from the housing 21 abuts on the housing inserting opening 17 of the lens cover 15. Thus, the housing 21 cannot be fitted to the cover to detect that the resistor 47 is not in a normally held state. On the other hand, when the resistor 47 is held in the housing 21 under a normally held state, the housing 21 is fitted to the lens cover 15. Further, after the housing 21 is fitted to the lens cover 15, the inserting rear part 83 of the resistor 47 abuts on the abutting surface 77 of the lens cover 15 to prevent the resistor 47 from slipping out from the housing 21.

Accordingly, in the connecting structure of the electronic device 11 according to the present embodiment, the partial inserted state of the resistor 47 can be detected and the resistor 47 can be prevented from slipping out.

According to the connecting structure according to the present invention, under the state that the electronic device is half inserted into the housing, when the housing is to be fitted to the cover, an inserting rear part of the electronic device protruding from the housing abuts on a housing inserting opening of the cover. Thus, the housing cannot be fitted to the cover to detect that the electronic device is not in a normally held state. On the other hand, when the electronic device is held in the housing under a normally held state, the housing is fitted to the cover. Further, after the housing is fitted to the cover, the inserting rear part of the electronic device abuts on an abutting surface of the cover to prevent the electronic device from slipping out from the housing.

According to the connecting structure according to the present invention, since the fitting direction of the housing to the cover intersects at right angles to the inserting direction of the electronic device to the housing, when the housing inserting opening of the cover abuts on the electronic device which is half inserted and protrudes from the housing, the electronic device is not moved forward or backward in the inserting direction, so that an insertion of the housing can be assuredly prevented. In other words, a partial inserted state can be detected.

According to the connecting structure according to the present invention, under a holding state that the inserting rear part of the electronic device slightly protrudes, when the housing is inserted into the cover, the inserting rear part of the electronic device abuts on the guide surface provided in the inner side edge part of the housing inserting opening. Then, when the housing is more inserted, the electronic device is pushed in to a normally held state by a reaction force from the guide surface. Thus, the electronic device can be assuredly attached under a normally held state to ensure an electric connection.

The present application is based on Japanese Patent Application No. 2010-258231 filed on Nov. 18, 2010, the contents of which are incorporated herein for reference.

The present invention is extremely useful in providing a connecting structure in which the partial inserted state of the electronic device can be detected and the electronic device can be prevented from slipping out.

What is claimed is:

1. A connecting structure for an electronic device, the connecting structure comprising:

a cover;

a housing, configured to be inserted into the cover; and a terminal, accommodated in the housing, and including an electrically conductive contact part configured to hold an electronic device, wherein the housing allows the electronic device to be inserted from an outside of the housing into the housing in a state where the terminal is accommodated in the housing, wherein the cover is configured to come in contact with the electronic device in a state where a part of the electronic device is inserted to the terminal, wherein the cover is configured to allow the housing to be inserted into the cover in a state where a whole part of the electronic device is inserted into the housing to be held at a normal position by the terminal, and wherein the cover has an abutting face preventing the electronic device from slipping out from the housing in a state where the housing is inserted into the cover.

2. The connecting structure as set forth in claim 1, wherein a direction in which the electronic device is inserted to the housing is orthogonal to a direction in which the housing is inserted to the cover.

3. The connecting structure as set forth in claim 1, wherein the cover is formed with an opening through which the housing is inserted to the cover, and wherein an inner edge part of the opening has at least one of a tapered face and a rounded face.

4. The connecting structure as set forth in claim 1, wherein the cover is configured to abut the electronic device if the electronic device is in the state where a part of the electronic device is inserted to the terminal.

5. The connecting structure as set forth in claim 1, wherein the cover is configured to permit detection of a partial inserted state of the electronic device.

6. The connecting structure as set forth in claim 1, wherein the housing includes a bottom plate, a bottom plate opening part formed in the bottom plate and a pair of holding grooves adjacent to the bottom opening part, wherein the bottom plate opening part is configured to receive the electronic device, and wherein the holding grooves are configured to engage the electronic device if the electronic device is in the state where a part of the electronic device is inserted to the terminal or if the electronic device is in the state where a whole part of the electronic device is inserted into the housing to be held at a normal position by the terminal.

* * * * *